US008858162B2

(12) United States Patent
Manzoori

(10) Patent No.: US 8,858,162 B2
(45) Date of Patent: Oct. 14, 2014

(54) LABYRINTH SEAL

(75) Inventor: Reza Manzoori, Derby (GB)

(73) Assignee: Rolls-Royce PLC, London (GB)

( * ) Notice: Subject to any disclaimer, the term of this patent is extended or adjusted under 35 U.S.C. 154(b) by 690 days.

(21) Appl. No.: 13/176,517

(22) Filed: Jul. 5, 2011

(65) Prior Publication Data

US 2012/0027575 A1 Feb. 2, 2012

(30) Foreign Application Priority Data

Jul. 29, 2010 (GB) ..... 1012719.9

(51) Int. Cl.

| | |
|---|---|
| ***F01D 11/02*** | (2006.01) |
| ***F04D 29/08*** | (2006.01) |
| ***F04D 29/10*** | (2006.01) |
| ***F01D 11/12*** | (2006.01) |

(52) U.S. Cl.

CPC ..... *F01D 11/02* (2013.01); *F01D 11/122* (2013.01); *F01D 11/127* (2013.01)

USPC ..... 415/116; 415/173.4; 415/174.4; 415/230

(58) Field of Classification Search

CPC ..... F01D 9/023; F01D 25/14; F01D 11/02; F01D 11/122; F01D 11/127; F05D 2240/55

USPC ..... 415/116, 173.1, 173.4, 173.6, 174.4, 415/174.5, 230

See application file for complete search history.

(56) References Cited

U.S. PATENT DOCUMENTS

| | | | | |
|---|---|---|---|---|
| 3,989,410 | A | 11/1976 | Ferrari | |
| 4,466,239 | A | 8/1984 | Napoli et al. | |
| 4,513,975 | A | 4/1985 | Hauser et al. | |
| 4,668,163 | A * | 5/1987 | Kervistin | 415/116 |
| 5,215,435 | A | 6/1993 | Webb et al. | |
| 5,281,090 | A * | 1/1994 | Starling | 277/413 |
| 7,775,766 | B2 * | 8/2010 | Meier et al. | 415/173.4 |
| 2009/0297341 | A1 | 12/2009 | Turnquist et al. | |

FOREIGN PATENT DOCUMENTS

| | | |
|---|---|---|
| EP | 1 057 976 A1 | 12/2000 |
| GB | 2 242 710 A | 10/1991 |
| GB | 2 409 247 A | 6/2005 |

OTHER PUBLICATIONS

Search Report issued in European Application No. 11 17 2722 dated Aug. 29, 2013.

Great Britain Search Report issued in British Application No. 1012719.9 dated Nov. 11, 2010.

* cited by examiner

*Primary Examiner* — Edward Look
*Assistant Examiner* — Jason Davis
(74) *Attorney, Agent, or Firm* — Oliff PLC

(57) ABSTRACT

A labyrinth seal is provided for forming a seal between a first and a second component which rotate relative to each other. The seal has an abradable lining mounted to the first component, and a plurality of fins projecting from the second component. The fins are arranged in abutment with the abradable lining to form a labyrinthal path for a flow of air through the seal. The seal further has a bypass passage which extends through the abradable lining. The bypass passage allows air to flow through the seal and bypass the labyrinthal path.

16 Claims, 3 Drawing Sheets

LABYRINTH SEAL

FIELD OF THE INVENTION

The present invention relates to a labyrinth seal for forming a seal between a first and a second component which rotate relative to each other.

BACKGROUND OF THE INVENTION

With reference to FIG. 1, a ducted fan gas turbine engine generally indicated at 10 has a principal and rotational axis X-X. The engine comprises, in axial flow series, an air intake 11, a propulsive fan 12, an intermediate pressure compressor 13, a high-pressure compressor 14, combustion equipment 15, a high-pressure turbine 16, and intermediate pressure turbine 17, a low-pressure turbine 18 and a core engine exhaust nozzle 19. A nacelle 21 generally surrounds the engine 10 and defines the intake 11, a bypass duct 22 and a bypass exhaust nozzle 23.

The gas turbine engine 10 works in a conventional manner so that air entering the intake 11 is accelerated by the fan 12 to produce two air flows: a first air flow A into the intermediate pressure compressor 13 and a second air flow B which passes through the bypass duct 22 to provide propulsive thrust. The intermediate pressure compressor 13 compresses the air flow A directed into it before delivering that air to the high pressure compressor 14 where further compression takes place.

The compressed air exhausted from the high-pressure compressor 14 is directed into the combustion equipment 15 where it is mixed with fuel and the mixture combusted. The resultant hot combustion products then expand through, and thereby drive the high, intermediate and low-pressure turbines 16, 17, 18 before being exhausted through the nozzle 19 to provide additional propulsive thrust. The high, intermediate and low-pressure turbines respectively drive the high and intermediate pressure compressors 14, 13 and the fan 12 by suitable interconnecting shafts.

Labyrinth seals are used throughout a gas turbine engine, and are designed to seal two components together whilst permitting a flow of air through the sealed boundary. An example of such a seal is between a casing component of the combustion equipment 15 and a cover plate protecting components of the high pressure turbine 16. The operating temperature of the high pressure turbine components needs to be kept at a safe level to maintain component integrity. This is achieved using a labyrinth seal to permit a purging flow of cooling air from the high pressure compressor 14 to the high pressure turbine 15 components and thereby preventing ingestion of hot working gas.

Labyrinth seals have two abutting surfaces; one surface having an abradable lining and the other having a series of fins. The fins provide resistance to air flow by forcing the air to traverse around the fins along a labyrinthal path. This resistance to air flow minimises performance penalties from air leakage.

During operation, thermal and mechanical movements of the gas turbine engine structure cause relative movement of the sealed components. Thus, the distance between the two abutting surfaces of the labyrinth seal changes throughout operation. This can result in periods during operation where the lining and fins are sufficiently close that the air flow through the seal is restricted to an unacceptable level. In the case where the seal has to allow a certain level of purging air flow through the seal, restriction of the flow through the seal can lead to hot gas ingestion causing damage or failure of engine components.

A conventional solution to this problem is to position the lining and fins sufficiently apart so they never run close enough during operation to over-restrict the air flow through the seal. However, this results in periods of operation where the distance between the lining and fins is larger than necessary, and has the effect of reducing performance efficiency of the engine.

SUMMARY OF THE INVENTION

Accordingly, an aim of the present invention is to provide a labyrinth seal in which air flow through the seal is better regulated.

In a first aspect, the present invention provides a labyrinth seal for forming a seal between a first and a second component which rotate relative to each other, the seal having: an abradable lining mounted to the first component, and a plurality of fins projecting from the second component and arranged in abutment with the abradable lining to form a labyrinthal path for a flow of seal air through the seal; wherein the seal further has a bypass passage which extends through the abradable lining to allow a portion of the seal air to flow through the seal and bypass the labyrinthal path.

Advantageously, the labyrinth seal of the present invention allows a metered flow of air independent of the relative positions of the first and second components. This means that the flow area of the bypass passage can be unaffected by the thermal and mechanical relative movements of the first and second components. Thus the bypass passage can ensure sufficient air flow through the labyrinth seal throughout operation.

Furthermore, because of the flow of air bypassing the labyrinthal path, precise regulation of the amount of air flowing though the labyrinthal path can be less critical. Accordingly, the fins and abradable material of the labyrinth seal can be run in a position that provides greater engine performance efficiency.

The labyrinth seal may have any one or, to the extent that they are compatible, any combination of the following optional features.

Typically, one of the components is a static component. An example of this type of seal is a seal with one static component and one rotating component.

Typically, the abradable lining is mounted to the static component. In this case, the plurality of fins project from the rotating component and abut the abradable lining as they rotate.

Preferably, the abradable lining is a honeycomb abradable lining. Typically, the cells of the honeycomb abradable lining extend across the thickness of the lining. Suitably, the cross section of the cells may be a regular polygon, such as a hexagon. A honeycomb abradable lining is advantageous because it can be lightweight. Alternatively, however, the abradable lining can be formed of e.g. sintered metal.

Conveniently, the abradable lining is stepped to further restrict the flow of air through the labyrinthal path, each fin abutting the abradable lining at a respective step. Advantageously, this allows a tighter seal to be formed, and thus limits performance losses from air leakage.

Preferably, the bypass passage has a sleeve for directing air flowing through the bypass passage. The sleeve can provide a direct channel for the bypass air, from the entrance to the exit of the bypass passage. When a honeycomb abradable lining is used, this helps to avoid bypass air escaping from the passage into adjacent honeycomb cells. The sleeve also allows the internal diameter of the passage to be easily selected to provide an aerodynamically efficient length over diameter ratio.

The entrance to the bypass passage can form a bell mouth. Such an entrance can improve the efficiency of air intake to the bypass passage, reducing aerodynamic losses and increasing the flow of air at the exit of the bypass passage.

The bypass passage may taper along its length. The taper can be used to control the velocity or pressure of the bypass air. Thus the taper can be changed to suit the required needs of the air flow system. A taper maybe provided such that it increases the diameter of the bypass passage at the passage exit, compared to the passage entrance, which can have the effect of decreasing the velocity at the exit compared to the entrance. Conversely, a taper maybe provided to increase the diameter of the bypass passage at the passage entrance compared to the passage exit. This can have the effect of increasing the velocity and decreasing the pressure of the air at the exit compared to the entrance.

Conveniently, the bypass passage can be angled relative to the axis of rotation of the first and second components to impart swirl to the air exiting the bypass passage. Advantageously, the swirl imparted to the exiting air flow can result in reduced windage losses. This in turn can lead to reduced heat pick up and increased efficiency. The bypass passage can be angled to direct the air flow to a specific location for localised cooling.

Preferably, the bypass passage is formed by electromachining. Suitably, the electromachining may be electro chemical or electro discharge machining.

Preferably, the labyrinth seal has a plurality of bypass passages. This allows an increased and/or distributed flow of bypass air through the seal, compared to only a single passage. For example, the labyrinth seal may have a plurality of bypass passages spaced circumferentially about the axis of rotation of the first and second components. This arrangement can help to reduce the risk of localised high temperatures.

Typically, first and second components are components of a gas turbine engine. For example, the first component may be a high pressure turbine static component such as a combustor rear inner case, and the second component may be a high pressure turbine rotating component such as a disc rim cover plate. The seal between these components is important because it controls a purging air flow from the high pressure compressor to critical components of the high pressure turbine. The structure of the labyrinth seal allows cooling air to be directed to these critical components whilst maintaining a close contact, and therefore tight seal, between the fins and the abradable material.

The bypass passage may extend through the abradable lining from a downstream end of the abradable lining to an upstream end of the abradable lining.

BRIEF DESCRIPTION OF THE DRAWINGS

Embodiments of the invention will now be described by way of example with reference to the accompanying drawings in which.

DETAILED DESCRIPTION

Figure 1:
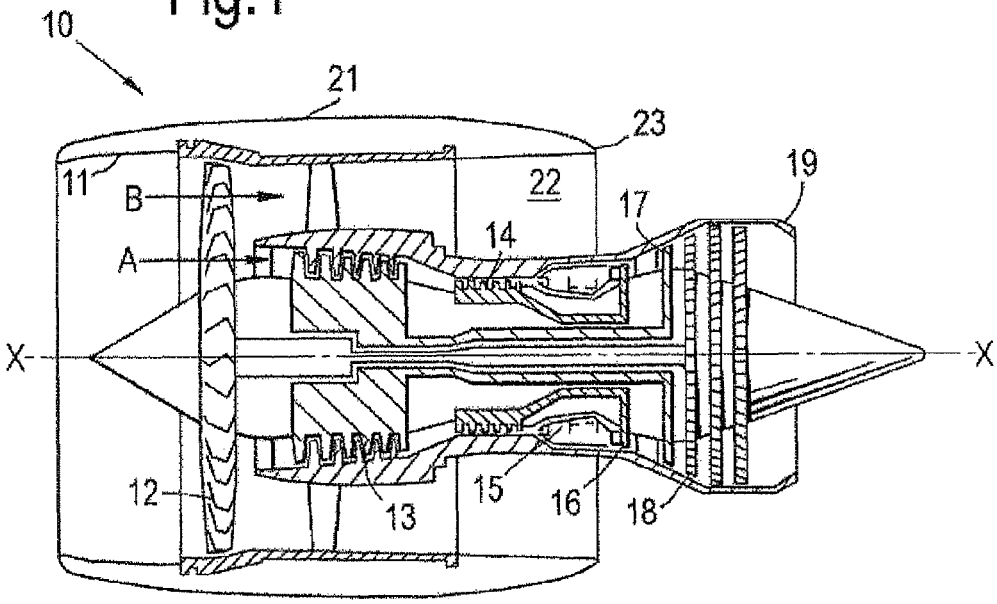
FIG. 1 shows schematically a longitudinal section through a ducted fan gas turbine engine.
Figure 2:
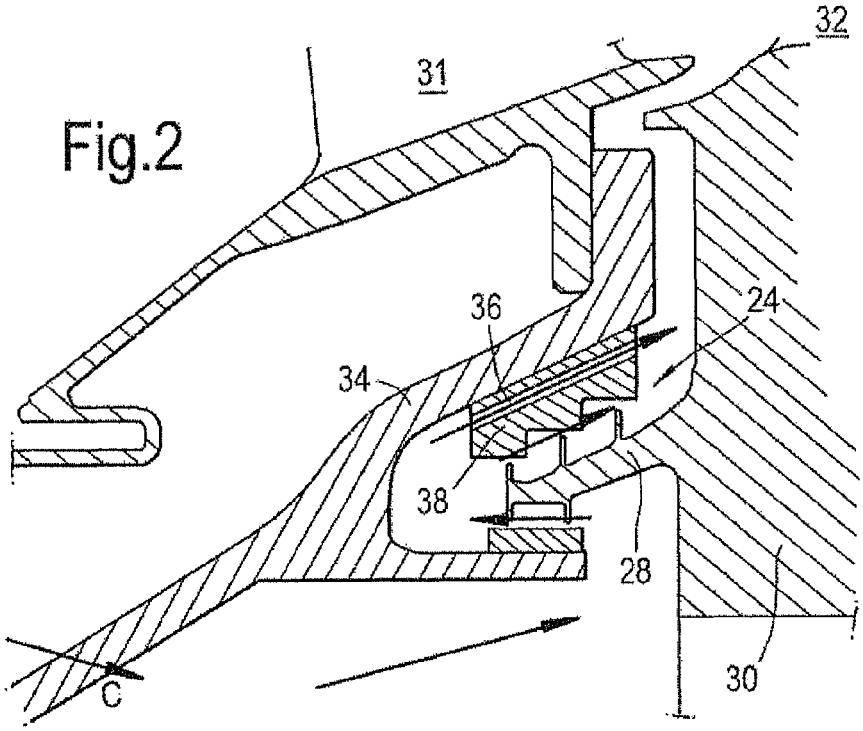
FIG. 2 shows schematically a longitudinal section of the region between the combustion equipment and the high pressure turbine of a gas turbine engine, a labyrinth seal being located between a combustor rear inner case and a rim cover plate.
Figure 3:
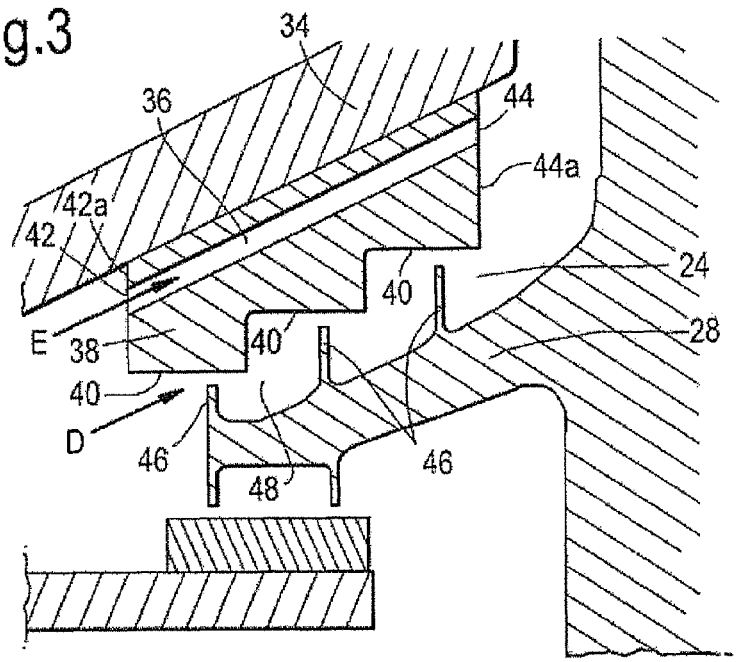
FIG. 3 shows schematically a closer view of the labyrinth seal of FIG. 2.

FIG. 2 shows schematically a longitudinal section of the region between the combustion equipment and the high pressure turbine of a gas turbine engine, a labyrinth seal 24 being located between a combustor rear inner case 34 and a rim cover plate 28. FIG. 3 shows schematically a closer view of the labyrinth seal 24 of FIG. 2. The rim cover plate 28 is positioned between the combustor rear inner casing 34 and a high pressure turbine disc 30 to protect the high pressure turbine disc 30, to which high pressure turbine blades 32 are attached. The rim cover plate 28 rotates about the axis of the gas turbine engine. The combustor rear inner case 34 is static, and has high pressure nozzle guide vanes 31 extending therefrom.

In operation, cooling combustion feed air from the high pressure compressor enters the combustion equipment of the engine at specified locations. In particular, air flow C (dashed arrowed line) from the high pressure compressor enters the combustor rear inner case 34. This air flow C passes through the labyrinth seal 24 to regulate the temperature of the rim of the high pressure turbine disc 30 by purging the air surrounding the rim and preventing ingestion of hot working gas.

The labyrinth seal 24 has an abradable honeycomb lining 38 which is attached to the combustor rear inner case 34. The sealing surface of the abradable lining 38 is formed as a series of steps 40. The honeycomb cells have metal foil walls and are aligned with their length direction extending across the thickness of the lining. The skilled person is familiar with the use of honeycomb abradable linings in labyrinth seal applications.

Fins 46 project from the rim cover plate 28 and abut the abradable lining 38. The arrangement of the steps 40 and the fins 46 is such that each fin 46 abuts a respective step 40 to form a labyrinthal path 48 for the flow of air between the lining 38 and the fins 46. The labyrinthal path 48 produces resistance to the flow of air D through the seal. In operation, the abutment of the fins 46 to the steps 40 is such that the fins 46 rub into the steps 40. The comparatively soft nature of the abradable material means that this rubbing removes material primarily from the abradable lining 38 rather than the fins, creating a tight seal without causing damage to the gas turbine components.

A plurality of circumferentially spaced bypass passages 36 extend through the abradable lining 38. The entrances 42 to the bypass passages 36 are on the combustion equipment side of the labyrinth seal 24, and the exits 44 are on the high pressure turbine side of the labyrinth seal 24. The passages 36 are separate from and do not interfere with the labyrinthal path 48. The bypass passages 36 provide a route for a further, metered, independent flow of air E through the labyrinth seal 24. The bypass passages preferably extend through the abradable lining from the entrance 42 at an upstream end 42*a* of the abradable lining to an exit 44 on a downstream end 44*a* of the abradable lining to bypass the seal fins.

Advantageously, in operation the majority of the air flow through the labyrinth seal 24 can be through the bypass passages 36. Thus the air flow E can provide most of the air necessary to regulate the temperature of the high pressure turbine disc 30. As there is therefore a reduced requirement for the air flow D through the labyrinthal path 48, the fins 46 and the steps 40 of the abradable lining 38 can operate in close abutment, thereby improving the efficiency of the engine by reducing air leakage through the seal and maximising feed pressure to the blade 32.

Figure 4:
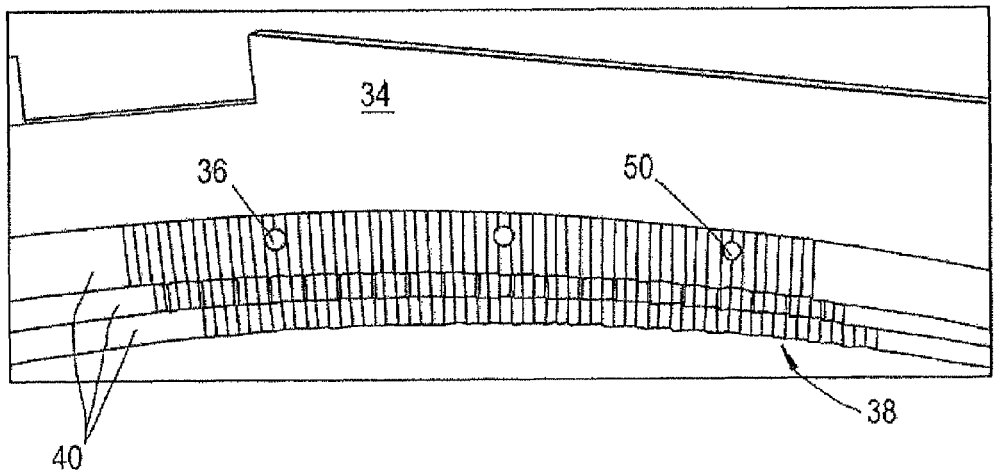
FIG. 4 shows a section of the abradable lining of the labyrinth seal of FIGS. 2 and 3 viewed from the exit side of the seal.
Figure 5:
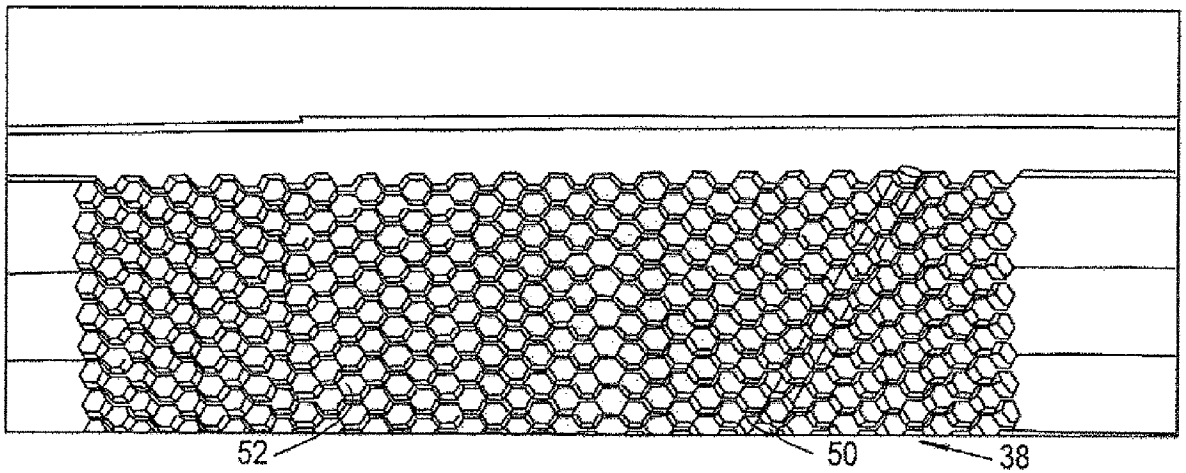
FIG. 5 shows the same section of abradable lining as FIG. 4 viewed from a position radially inside the seal.
Figure 6:
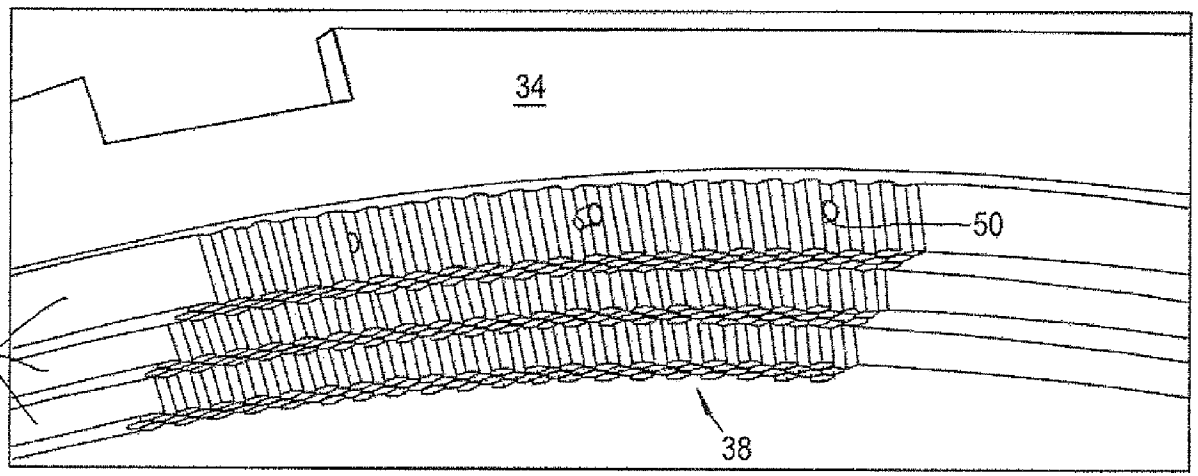
FIG. 6 shows the same section of abradable lining as FIGS. 4 and 5 in a perspective view from the exit side of the seal.

The abradable lining 38 extends circumferentially around the combustor rear inner case 34, and FIG. 4 shows a section of the abradable lining 38 viewed along the axial direction from the exit side of the seal 24. The exits 44 from three of the circumferentially spaced bypass passages 36 are visible. FIG. 5 shows the same section of the abradable lining 38 but viewed from a position radially inside the lining. FIG. 6 shows the same section of the abradable lining 38 in a perspective view from the exit side of the seal 24. As best shown in FIG. 5 the bypass passages 36 are angled relative to the axis of rotation to impart swirl on the air flow E as it exits the passages 36, the swirl being in the same direction as the direction of rotation of the high pressure turbine disc 30. The swirl has the effect of reducing windage losses, which in turn reduces heat pickup and increases efficiency. The angling also allows the flow, where necessary, to be directed to specific regions of the high pressure turbine disc 30 or the high pressure turbine blade 32. This can be significant if there is a risk of localized overheating.

The bypass passages 36 are formed in the honeycomb lining 38 before assembly to the gas turbine engine 10, using electro chemical or electro discharge machining.

The bypass passages 36 are lined with respective sleeves 50, although only one such sleeve is shown in FIGS. 4, 5 and 6. The sleeve 50 extends from the entrance 42 to the exit 44 of the bypass passage, and can be formed as a smooth cylindrical metal tube. The outside diameter of the tube is dimensioned to fit securely in the bypass passage 36. The inner diameter of the tube is dimensioned to provide a length to diameter ratio which best improves aerodynamic efficiency. Advantageously, the sleeve prevents air escaping from the passage into the cells 52 of the honeycomb.

The sleeve 50 of the bypass passage 36 can be inserted into the bypass passage, and then affixed using brazing or welding. If brazing is used, the sleeve can be inserted and brazed to the abradable lining 38 at the same time as the abradable lining 38 is brazed to the combustor rear inner case 34 of the gas turbine engine 10. If welding is used, the abradable lining can first be brazed to the combustor rear inner case 34, and then the sleeve 50 can be inserted into the bypass passage 36 and welded to the abradable lining 38.

While the invention has been described in conjunction with the exemplary embodiments described above, many equivalent modifications and variations will be apparent to those skilled in the art when given this disclosure. Accordingly, the exemplary embodiments of the invention set forth above are considered to be illustrative and not limiting. Various changes to the described embodiments may be made without departing from the spirit and scope of the invention.

The invention claimed is:

1. A labyrinth seal for forming a seal between a first and a second component which rotate relative to each other, the seal having:

an abradable lining mounted to the first component, and a plurality of fins projecting from the second component and arranged in abutment with the abradable lining to form a labyrinthal path for a flow of seal air through the seal;

wherein the seal further has a bypass passage which extends through the abradable lining and is separate and distinct from the labyrinth path to allow a metered independent purging flow of air through the seal bypassing the labyrinthal path.

2. A seal according to claim 1, wherein one of the components is a static component.

3. A seal according to claim 2, wherein the abradable lining is mounted to the static component.

4. A seal according to claim 1, wherein the abradable lining is a honeycomb abradable lining.

5. A seal according to claim 1, wherein the abradable lining is stepped to further restrict the flow of air through the labyrinthal path, each fin abutting the abradable lining at a respective step.

6. A seal according to claim 1, wherein the bypass passage has a sleeve for directing air flowing through the bypass passage.

7. A seal according to claim 1, wherein the bypass passage tapers along its length.

8. A seal according to claim 1, wherein the bypass passage is angled relative to the axis of rotation of the first and second components to impart swirl to the air exiting the bypass passage.

9. A seal according to claim 1, wherein the bypass passage is formed by electromachining.

10. A seal according to claim 1, having a plurality of bypass passages.

11. A seal according to claim 10, wherein the plurality of bypass passages are spaced circumferentially about the axis of rotation of the first and second components.

12. A seal according to claim 1, wherein the first and second components are components of a gas turbine engine.

13. A seal according to claim 12, wherein the first component is a high pressure turbine static component, and the second component is a high pressure turbine rotating component.

14. A gas turbine engine having the seal according to claim 1.

15. A seal according to claim 1, wherein the bypass passage extends through the abradable lining from an upstream end of the abradable lining to a downstream end of the abradable lining.

16. A seal according to claim 1, wherein an inlet to the bypass passage is provided on an upstream face of the abradable lining, and an exit to the bypass passage is provided on a downstream face of the abradable lining.

* * * * *